US007437975B1

(12) United States Patent
De Anfrasio

(10) Patent No.: US 7,437,975 B1
(45) Date of Patent: Oct. 21, 2008

(54) WRENCH SOCKET

(76) Inventor: Michael De Anfrasio, 28010 Redwood Glen Rd., Valencia, CA (US) 91354

( * ) Notice: Subject to any disclaimer, the term of this patent is extended or adjusted under 35 U.S.C. 154(b) by 0 days.

(21) Appl. No.: 10/429,471

(22) Filed: May 6, 2003

Related U.S. Application Data

(60) Provisional application No. 60/379,679, filed on May 13, 2002.

(51) Int. Cl.
*B25B 13/06* (2006.01)
*B25B 13/02* (2006.01)

(52) U.S. Cl. ..... 81/121.1; 81/125

(58) Field of Classification Search ..... 81/121.1, 81/125

See application file for complete search history.

(56) References Cited

U.S. PATENT DOCUMENTS 1,590,200 A * 6/1926 McGuckin ..... 81/120
3,369,441 A * 2/1968 Kosar ..... 411/410
4,126,063 A * 11/1978 Palmer ..... 81/124.6
4,644,831 A * 2/1987 Yang ..... 81/125
4,663,998 A * 5/1987 Parsons et al. ..... 81/125
4,787,278 A * 11/1988 Bononi ..... 81/438
4,934,226 A * 6/1990 Dacey, Jr. ..... 81/125
5,269,208 A * 12/1993 Kolvites et al. ..... 81/176.2
5,277,531 A * 1/1994 Krivec ..... 411/403
5,340,256 A * 8/1994 Morgan ..... 411/405
5,347,892 A * 9/1994 Moetteli ..... 81/177.85
5,682,801 A * 11/1997 Waechter ..... 81/121.1
6,003,411 A * 12/1999 Knox et al. ..... 81/53.2
6,006,630 A * 12/1999 Vasichek et al. ..... 81/125
6,598,498 B1 * 7/2003 Pigford et al. ..... 81/53.2

* cited by examiner

*Primary Examiner*—Willmon Fridie
(74) *Attorney, Agent, or Firm*—Vernon R. Yancy, Esq.

(57) ABSTRACT

A wrench socket having a cylindrical body with a receptacle at one end opening exteriorly thereof to insertably receive a head or nut carried on a fastener. The sidewall of the receptacle is tapered inwardly from the open end to a bottom of the socket which defines the depth. The sidewall provides a straight wall entrance leading into the tapered sidewall portion. The angle of taper of the sidewall is sufficient to accommodate a particular range of sized and shaped fastener heads or nuts. Additionally, the opposite end of the body includes a detachable coupling with the end of a wrench so that the socket can be turned to loosen or tighten the fastener.

2 Claims, 3 Drawing Sheets

WRENCH SOCKET

Priority claimed on Ser. No. 60/379,679 filed May 13, 2002.

BACKGROUND OF THE INVENTION

1. Field of the Invention

The present invention relates to the field of hand tools, and more particularly to a novel releasable wrench socket having a tapered walled receptacle for insertably receiving a variety of sized fastener heads, and which further includes yieldable means for retaining the socket onto the wrench.

2. Brief Description of the Prior Art

In the past, it has been the conventional practice to produce wrench sockets which have a receptacle having stamped straight parallel sidewalls so that the distance between the sidewalls will accept only a particular sized metric or standard head dimension of a fastener. Generally, such conventional sockets are provided with six, eight, or twelve points. Therefore, a set of sockets are required in order to accommodate a full range of sizes. Particularly in the case of metric fastener heads, workmen sometimes attempt to employ non-metric receptacles on sockets to work metric heads on fasteners, which causes damage to both the socket and the fastener head. Because of the straight wall on the conventional sockets, only fastener heads of the same dimension are intended to fit within the receptacle of the socket and, in fact, only conformal receptacles and fastener heads can be mated particularly in size and shape.

Therefore, a long-standing need has existed to provide a universal-type of wrench socket which includes tapered inwardly diverging non-parallel sidewalls so as to accommodate insertion and engagement with a variety of sized and shaped fastener heads. The inventive wrench socket should hold nuts and bolts and be employed for any application requiring the nuts or bolts to be placed in difficult areas normally unreachable by the workman. The wrench socket should have the capability of releasably retaining bolts or nuts in the receptacle in addition to the ability to accommodate a variety of different bolt or nut sizes and shapes.

SUMMARY OF THE INVENTION

Accordingly, the above problems and difficulties are avoided by the present invention which provides a novel wrench socket having a cylindrical body with a receptacle at one end opening exteriorly thereof in order to insertably receive a bolt head or nut carried on a fastener. The sidewall of the receptacle is tapered inwardly from the open end to a bottom of the socket which defines the depth thereof. The sidewall may provide a straight wall entrance leading into the tapered sidewall portion of the receptacle or the tapered sidewall may commence directly at the opening or entrance to the receptacle and terminate at the bottom. The angle of taper or slope of the sidewall is the design of the manufacturer but is intended to be sufficient to accommodate a particular range of sized and shaped fastener heads or nuts. Additionally, the opposite end of the body includes a means for detachably coupling with the end of a wrench so that the socket can be turned to loosen or tighten the fastener. Means are also provided for yieldably holding the fastener into the receptacle on the body, and such means may take the form of a resilient seal, a coil spring, or other snap-lock arrangement. Such arrangement is formed in the sidewall of the socket surrounding the tapered wall receptacle.

Therefore, it is among the primary objects of the present invention to provide a novel wrench socket that includes a tapered inward sidewall for receiving a variety of sized and shaped fastener heads or nuts.

Another object of the present invention is to provide a unitary wrench socket which is yieldably connected to a fastener wherein the fastener may be of different sizes and shapes.

Yet another object resides in providing a wrench socket with a tapered wall inclined from the opening of a receptacle to the bottom of the receptacle which will accommodate metric and non-metric or standard sizes and shapes.

Still a further object is to provide a wrench socket that is stronger than conventional or standard sockets because of a tapered inner sidewall which permits the construction of the socket to be thicker and which gives an advantage of overall strength.

Yet a further object resides in providing a wrench socket that can be used on any type of bolt or nut regardless of what material the bolt or nut is formed from.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
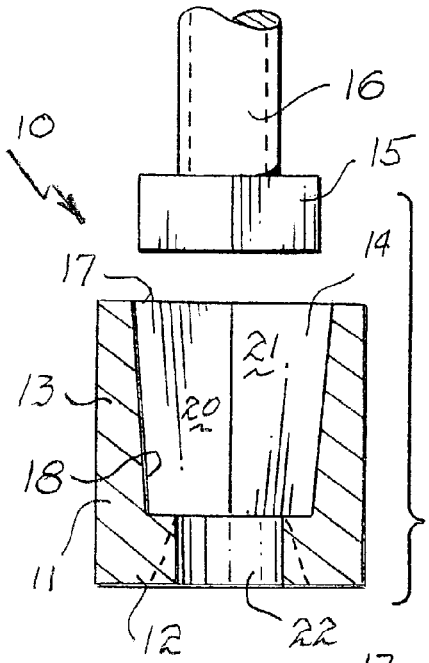
FIG. 1 is an exploded view, partly in cross-section, of the novel wrench socket incorporating the present invention.

Referring now to FIG. 1, the novel wrench socket incorporating the present invention is illustrated in the general direction of arrow 10 which includes a cylindrical body 11 having a bottom 12 and an upwardly projecting sidewall 13 which defines a central receptacle or opening 14 intended to insertably receive a head 15 of a conventional fastener 16. The receptacle 14 is defined by the inner surface of the sidewall 13 and it is of major significance that the sidewall inner surface be tapered downwardly from entrance 17 to the bottom 12 and the tapered inner sidewall is indicated by numeral 18. The taper inner wall construction is useful for a variety of nut drives, such as impact sockets, deep sockets and 6, 8, or 12 point sockets.

The entrance 17 leading into the receptacle 14 may be of any geometrical shape or configuration such as square, hexagon, octagon or the like. In the present illustration, an example illustrates a six-sided or point entrance leading into the receptacle. Therefore, it can be seen that the inner wall 18 is divided into a plurality of flat surfaces such as indicated by flats 20 and 21. The geometry of the head 15 of the fastener 16 is intended to match the geometry of the entrance 17 leading into the receptacle 14. Also, the head 15 includes peripheral flats which enable insertion of the head into the receptacle.

An access opening 22 is provided in the bottom 12 and is open-ended so as to communicate with the receptacle 14. The access opening is used to insertably receive a plunger or other implement to force the fastener 16 out of the receptacle at the end of a procedure. The opening 22 may be provided with an inner tapered sidewall as previously described, as shown in broken lines, so a single socket has two different sizes. One end may have a metric size, while the opposite end may have a standard size, as an example. Also, different sizes of metric or standard measures may be employed on the same socket.

Figure 2:
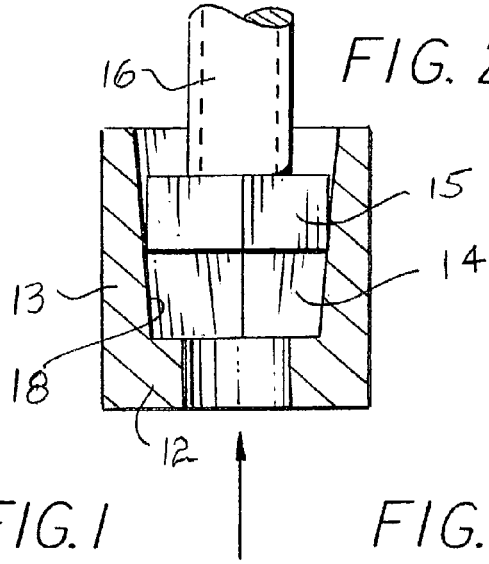
FIG. 2 is a view similar to the view of FIG. 1 illustrating engagement of a fastener with the tapered sidewall of the socket.

Referring now in detail to FIG. 2, it can be seen that the head 15 of fastener 16 has been introduced into the receptacle 14 and has progressed downwardly until the edge of the head 15 engages with the tapered surface of the sidewall 18. The fastener head 15 will only progress through the receptacle 14 until engagement with the sidewall occurs. At this time, rotation of the wrench or socket can be achieved to turn the fastener. It is to be understood that the socket 10 may be held on the end of a wrench or may be employed on the chuck of a drill-type turning device or the like. The means for turning the sockets do not form a part of the present invention.

Figure 3:
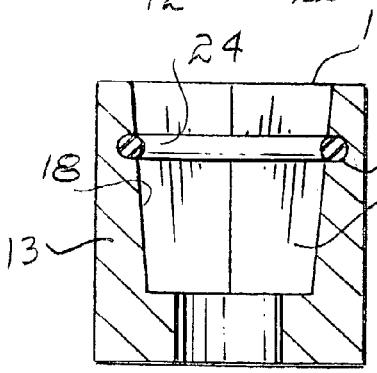
FIG. 3 is a transverse, cross-sectional view of another embodiment of the present invention, incorporating a yieldable connector for releasably holding the fastener in the receptacle of a socket.

Referring now in detail to FIG. 3, it can be seen that the body 13 of the socket 10 includes a yieldable O-ring identified by numeral 24. A portion of the inner diameter of the ring projects into the receptacle 14 and acts as a seal and yieldable means for holding the fastener in position when the fastener head is inserted into the receptacle 14. The O-ring 24 is mounted in a semi-circular groove 25 which is formed in the tapered surface 18 of the sidewall. Therefore, when the head 15 of the fastener 16 is inserted through the entrance 17 of the receptacle, engagement with the O-ring 24 will occur and the head will pass the O-ring into a deeper portion of the receptacle where engagement with the sidewall 18 takes place.

Figure 4:
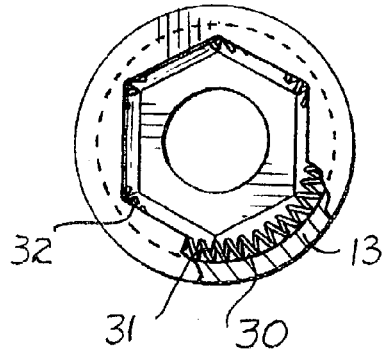
FIG. 4 is a top plan view of another embodiment incorporating a yieldable connector in the form of a coil spring.

Referring now to FIG. 4, another version of retaining means for yieldably holding the head 15 of the fastener 16 in the receptacle resides in providing a groove 30 in the sidewall 13 which is then occupied by a spring 31. A portion of the spring resides within the receptacle 14 and that portion of the spring is indicated by numeral 32 where the projection of the spring occurs at a point or corner where adjacent flats meet. As previously described, the receptacle is defined by downwardly tapered sidewalls. Both the O-ring 24 and the coil spring 31 serve to resiliently and releasably retain the fastener head in position during a socket turning procedure.

Figure 5:
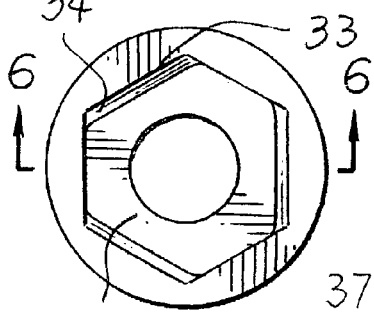
FIG. 5 is a top plan view of still another embodiment of the invention illustrating a receptacle sidewall having a partial flat face and a partial tapered face.
Figure 6:
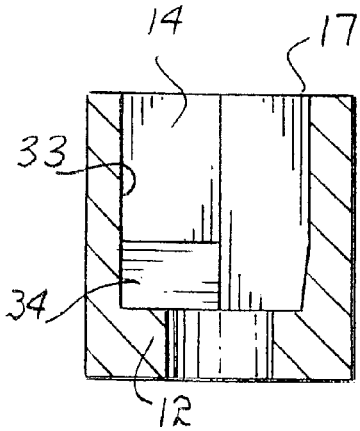
FIG. 6 is a transverse, cross-sectional view of the socket shown in FIG. 5 as taken in the direction of arrows 6-6 thereof.
Figure 10:
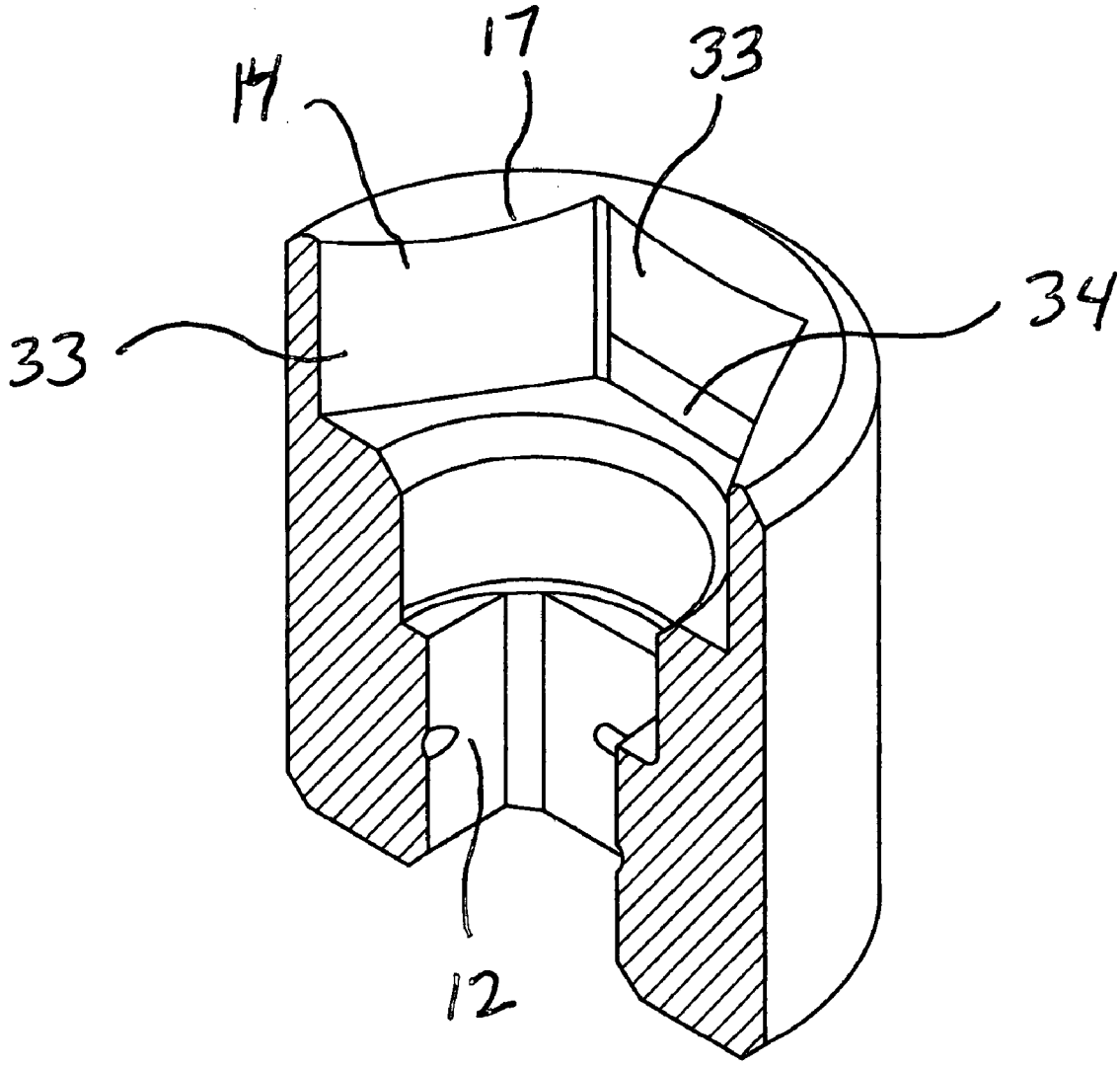
FIG. 10, is a perspective view of the cross-sectional view of the socket of FIG. 6.

Referring now in detail to FIGS. 5, 6 and 10, another embodiment of the invention is illustrated wherein the receptacle 14 commences at entrance 17 with flat and non-tapered walls, such as wall 33, followed adjacently by tapered walls, such as tapered wall 34, continuing to the bottom 12 of the cylindrical body. As illustrated in FIGS. 6 and 10, the sidewall of the receptacle 14 may provide a straight wall 33 entrance leading into the tapered sidewall portion 34 of the receptacle 14 or the tapered sidewall 34 may commence directly at the opening or entrance to the receptacle and terminate at the bottom 12.

Figure 7:
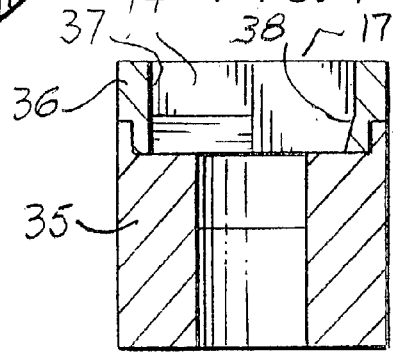
FIG. 7 is a transverse, cross-sectional view of still another embodiment of the present inventive wrench socket.

In FIG. 7, a different version of wrench socket is illustrated which is of a two-component construction having a major body portion 35 on which a upper portion 36 is seated. The upper portion 36 includes a receptacle 14 which is similar to the receptacle disclosed and described with respect to FIG. 6. The entrance 17 leading into the upper portion has a flat wall 37 while tapered wall 38 terminates with the lower socket section 35.

Figure 8:
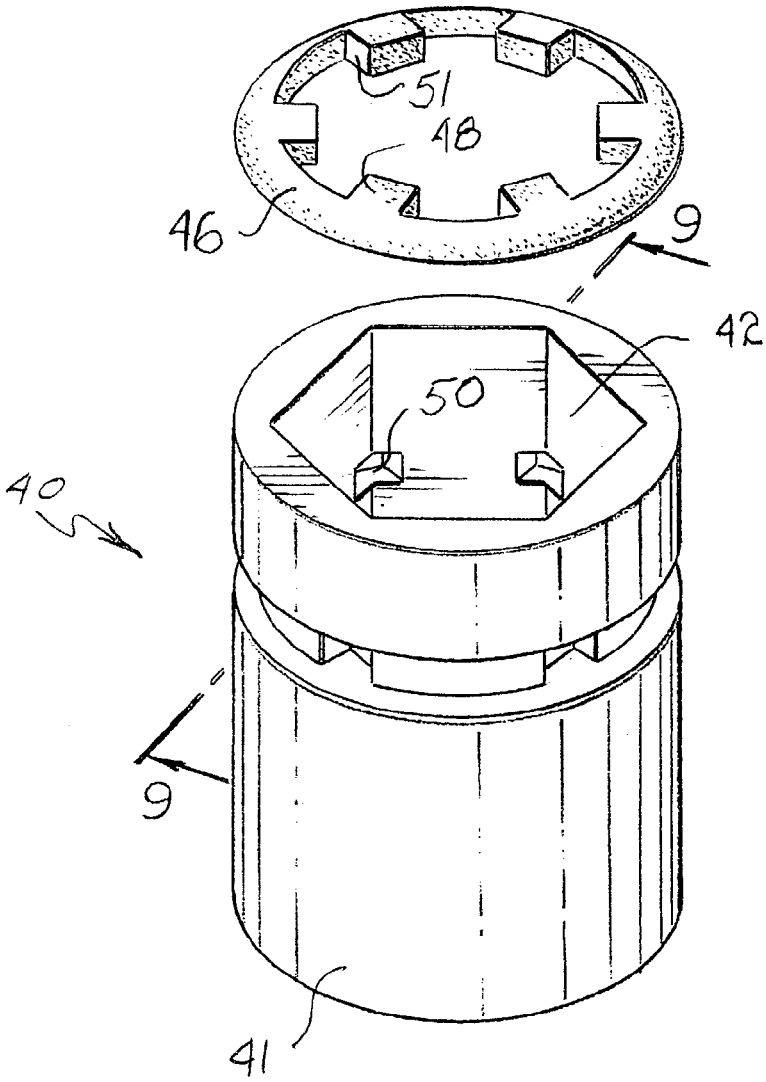
FIG. 8 is a perspective view of another version of the present invention.
Figure 9:
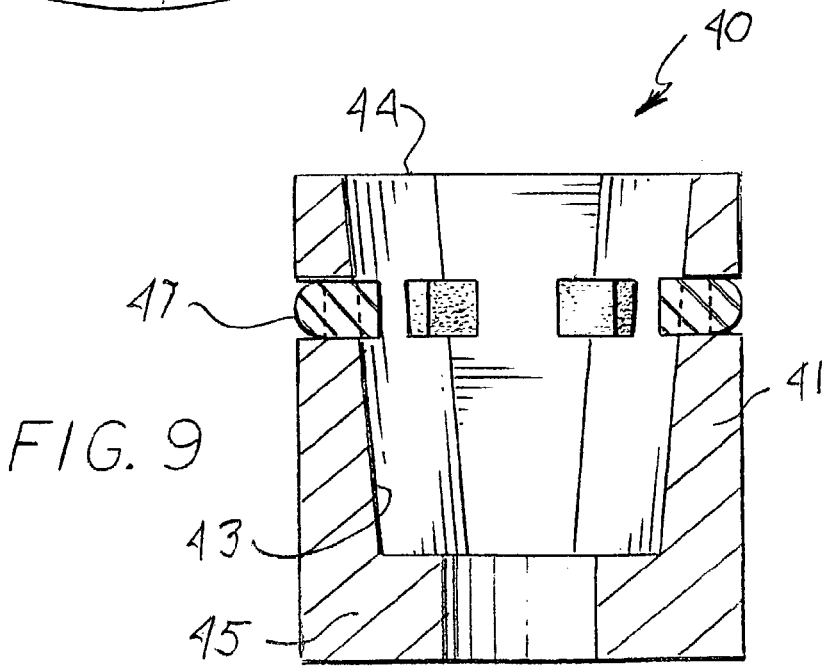
FIG. 9 is a transverse, cross-sectional view of the wrench socket version shown in FIG. 8 as taken in the direction of arrows 9-9.

Referring now in detail to FIGS. 8 and 9, still another embodiment of the invention is illustrated in the general direction of arrow 40 which includes a cylindrical body 41 having an internal receptacle 42 which is defined by an inner tapered wall, such as indicated by numeral 43. The entrance 44 leading into the receptacle may be of any geometric configuration but is illustrated as being of a hexagon configuration. The tapered wall 43 includes a plurality of flats which are arranged in the hexagon geometry and which terminate at the bottom 45 of the body 41.

The receptacle 42 includes an interference means, similar to the O-ring 24, the coiled spring 30, or any other usable means, in that the embodiment 40 includes a special retainer 46 which is circular and includes rounded periphery, as indicated by numeral 47. The inner periphery includes a plurality of projections such as indicated by numerals 48 and the projections are arranged in fixed, spaced-apart relationship about the inner diameter of the ring 46. Each of the respective projections projects through an opening in the body, such as an opening 50 shown in FIG. 8, wherein the projection 51 may be inserted therein so as to project into the receptacle 42. Thus, the projections are in interference with the insertion of the head 15 of a fastener 16. The composition of the ring 46 is similar to the composition of the O-ring 24 and the projections are compressible so as to be yieldable to the insertion and removal of the fastener head to and from the receptacle.

Therefore, it can be seen that the novel wrench socket of the present invention provides a receptacle which, in effect, grasps the head of a fastener and releasably retains of the fastener in the receptacle of the socket. The main feature of the invention is the inside tapered wall of the receptacle and it is to be particularly noted in all of the versions, the socket receptacle is tapered inwardly instead of stamped straight down as in conventional sockets. It is intended that the inventive socket will be available in all sizes, including metric and standard, and will include receptacle geometry which may have six, eight, or twelve points. The inventive socket is stronger than conventional sockets because the tapered inner wall for the receptacle will cause the outer wall to be slightly thicker. The uniqueness of the invention permits the inventive socket to be used on any type of bolt or head regardless of what the bolt is composed of. It is intended that the inventive socket will also have a chrome finish that will allow a user to identify the difference between the inventive socket and other standard or conventional sockets that are available. It is an object of the inventive socket to hold nuts and/or bolts in place in hard-to-get areas so as to avoid injuries to hands and arms. Use of the inventive wrench socket permits mechanics, or others who work on engines or applications requiring a wrench socket in difficult or tight workplaces, will especially have need for the inventive socket. The use of the inventive socket allows the user to work in tight places without injury or damage. Once the socket is set in place, the user can line it up with the head of the nut and begin tightening or loosening, whichever is required.

It is to be understood that the receptacle 14 is not "conical" but is in a flat, tapered plane. Prior disclosure, such as described in U.S. Pat. No. 6,003,411 are related and limited to fastener engaging surfaces forming a conical segment in transverse, cross-sectional perpendicular to an axis of rotation. The shape of receptacle 14 may be of a variety of different geometric configurations but not including conical.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A socket comprising:

a cylindrical body having at least one elongated receptacle defined by an inner sidewall;

said inner sidewall having one open end;

said body having a bottom end separated by said sidewall in fixed, spaced-apart relationship with respect to said open end which defines a depth thereof;

said inner sidewall comprising a plurality of non-tapered portions and tapered portions adjacently configured, wherein said tapered portions slope inwardly from an inner bottom portion to an inner sidewall midsection;

said tapered portions of said sidewall having a straight portion leading from said open end to said tapered portion;

said tapered portions of said sidewall comprises an angle of taper adapted to accommodate a selected size range of a mating fasteners;

said bottom end includes an aperture for inserting a tool for dislodging said fastener from said receptacle of said body; and said body includes means carried on said sidewall projecting into said receptacle for yieldably holding said fastener with said body, wherein one of said plurality of non-tapered portions being configured longitudinally adjacent to one of said plurality of tapered portions, wherein said holding means is selected from one of a resilient seal, a coil spring and a snap-lock.

2. The socket defined in claim 1, wherein:

said body includes a lower section supporting an upper section;

said upper section having said receptacle extending between said open end and said lower section; and said tapered portion provided in said receptacle of said upper section.

* * * * *